United States Patent [19]

Winslow

[11] 3,939,550

[45] Feb. 24, 1976

[54] METHOD OF MAKING SPOUT CONSTRUCTION FOR USE IN LIQUID CONTAINERS

[76] Inventor: Samuel J. Winslow, 19 Clarendon Ave., Providence, R.I. 02906

[22] Filed: Jan. 3, 1975

[21] Appl. No.: 538,419

Related U.S. Application Data

[60] Division of Ser. No. 359,885, May 14, 1973, Pat. No. 3,893,601.

[52] U.S. Cl. ..... 29/458; 29/463; 113/116 DD; 113/120 A; 113/120 P

[51] Int. Cl.[2] ..... B23P 3/00; B23P 25/00

[58] Field of Search ..... 29/458, 463; 113/116 DD, 113/120 A, 120 P; 222/566

[56] References Cited

UNITED STATES PATENTS

| | | | |
|---|---|---|---|
| 229,482 | 6/1880 | Simmons | 222/566 |
| 252,963 | 1/1882 | Palmer | 113/120 P X |
| 266,736 | 10/1882 | Warwick | 113/120 P X |
| 309,788 | 12/1884 | Krippendorff et al. | 113/120 P UX |
| 502,046 | 7/1893 | Milne et al. | 113/120 P |
| 877,321 | 1/1908 | Gebler | 113/120 P X |
| 877,322 | 1/1908 | Gebler | 222/566 |
| 2,026,839 | 1/1936 | Krause | 222/566 |
| 2,795,844 | 6/1957 | Liszak | 29/458 |

*Primary Examiner*—Charlie T. Moon
*Attorney, Agent, or Firm*—Salter & Michaelson

[57] ABSTRACT

A spout for attachment to a liquid container including a pair of interconnected complementary spout elements formed of a base material, a protective plating being applied to the inside surface of each spout element prior to the joining thereof into the assembled spout, thereby avoiding any possible harmful effects that might have resulted from contact of the liquid with the base material when the liquid is poured through the spout.

6 Claims, 6 Drawing Figures

METHOD OF MAKING SPOUT CONSTRUCTION FOR USE IN LIQUID CONTAINERS

BACKGROUND OF THE INVENTION

This is a divisional application based on U.S. application serial No. 359,885filed May 14, 1973, now U.S. Pat. No. 3,893,601.

The present invention relates to hollowware such as a spout construction of the type normally used with coffee and tea containers.

Prior to the instant invention, metal spouts as used in relatively inexpensive metal coffee and tea pots have sometimes been cast of a lead material. There have been indications that liquid passing through a spout formed of lead could become contaminated, and this would be deleterious for human sonsumption.

Since the use of container spouts formed of a lead alloy can be harmful when contacted by a liquid passing therethrough, some efforts have been made to cast such spouts of tin or an alloy of tin, which essentially overcomes the objections to cast lead spouts. However, the casting of a tin alloy container in a spout as utilized in inexpensive tea or coffee pots greatly increases the cost of the container and has rendered the manufacture of such containers impractical.

Nor is it possible to cast the spout of lead as a one piece unit and then plate the inner surface thereof, since presently used plating techniques do not permit effective plating of the interior surface of a spout of this type.

SUMMARY OF THE INVENTION

The present invention relates to a container spout and method of forming the spout, and comprises a pair of complementary spout elements that are cast of a lead alloy material. Each of the spout elements define a half of the complete spout construction; and after the casting thereof, a protective coating, preferably consisting of a copper-nickel plating, may be easily applied to the inside surface of each spout element. The protective coating as applied to the inside surface of each spout element forms a continuous inner wall when the spout elements are joined by soldering and avoids any deleterious effects that might be obtained from the lead if contacted by the liquid when the container to which the spout construction is joined is in use, and when liquid in the container is poured through the spout.

The spout elements in the subject invention are joined together by soldering, a strip of soldering material being inserted into opposed grooves as formed in peripheral surfaces of the spout elements, and the soldering strip having a melting point of predetermined temperature. When the spout construction as assembled is secured to the liquid container, a solder material having a melting temperature somewhat less that that used in joining the spout elements is employed.

Accordingly, it is an object of the present invention to provide a spout construction for use in a liquid container that comprises a pair of complementary spout elements formed of a lead material, the inner surfaces of which have a protective coating applied thereto prior to assembly of the elements to form the completed spout.

Another object of the invention is to teach a method of forming a spout for use in a liquid container wherein complementary spout elements are cast of a lead material and the inside surfaces of the cast lead spout elements are coated with a protective coating prior to allembly of the elements to form the completed spout.

Another object of the invention is to provide a spout for use in a liquid container that comprises a pair of spout elements that are cast of a lead material and that have a protective coating applied to the inside surfaces thereof, the protective coating comprising a conventional copper-nickel plating.

Still another object is to teach a method of forming a spout construction for a liquid container by casting complementary spout elements of a lead material, applying a protective coating to the inside surfaces of the spout elements and then soldering the spout elements together to form an opening therein through which liquid passes from the liquid container without being subject to any deleterious effects of the lead from which the spout elements are cast.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
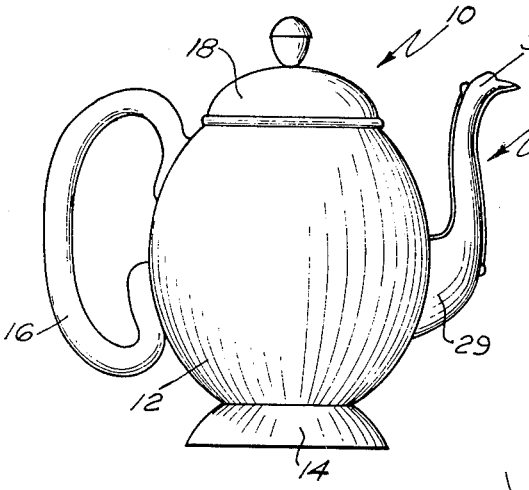
FIG. 1 is an elevational view of a metal liquid container such as a tea or coffee pot which incorporates the spout construction of the present invention.

Referring now to the drawing and particularly to FIG. 1, a metal container is illustrated and is generally indicated at 10. The metal container 10 is of the conventional tea or coffee pot design and includes a body 12 formed of any suitable metallic material to which a base 14 and a handle 16 are joined and on which a removable top or cover 18 is mounted. A spout generally indicated at 20 and of special construction as formed in accordance with the present invention is also joined to the body 12.

Figure 2:
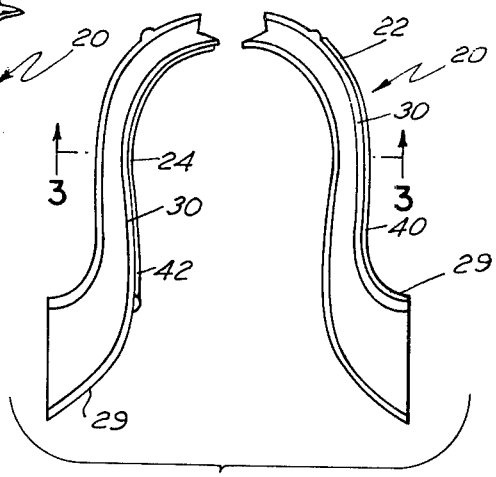
FIG. 2 is a plan view of complementary spout elements as cast from a lead material and after a protective coating has been applied to the inside surfaces thereof.
Figure 3:
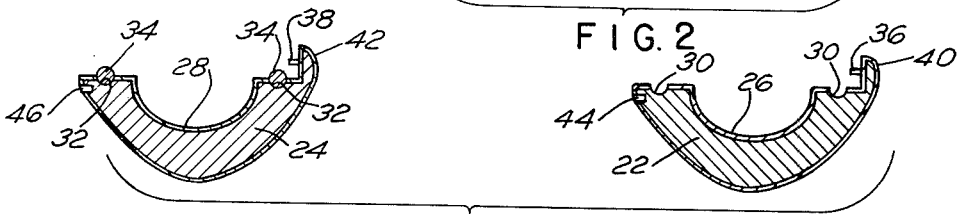
FIG. 3 is a sectional view taken along line 3—3 in FIG. 2.
Figure 4:
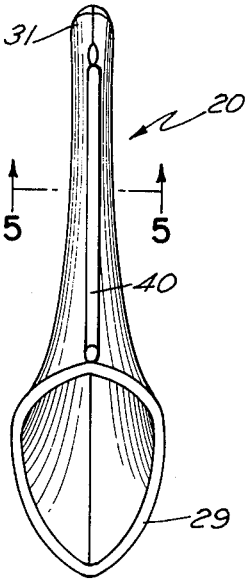
FIG. 4 is a rear elevational view of the completed spout construction and prior to the joining thereof to the liquid container.
Figure 5:
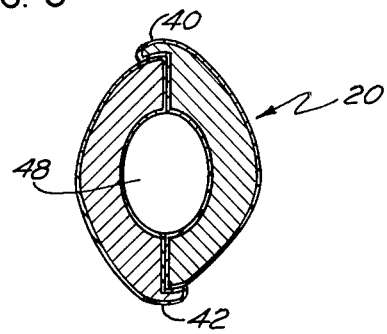
FIG. 5 is a sectional view taken along line 5—5 in FIG. 4.
Figure 6:
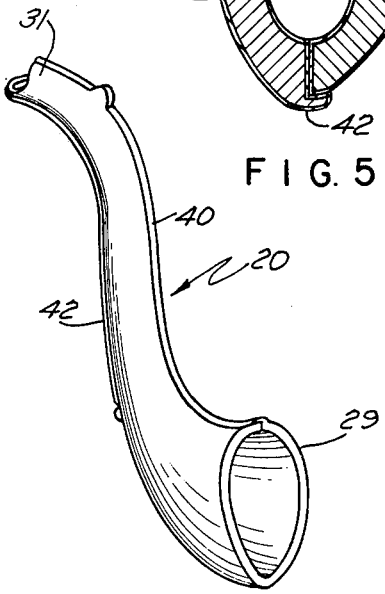
FIG. 6 is a perspective view of the assembled spout construction.

The spout 20 as illustrated in FIGS. 2, 3 and 5, is formed of complementary half elements 22 and 24 that are cast in any conventional manner in order to form a hollow construction when joined together; and as contemplated herein, the elements 22 and 24 are cast of a lead alloy. Lead alloy is used as the material for casting the spout elements 22 and 24, since this material is relatively inexpensive and is simple to cast in the required shape and configuration. As illustrated in FIGS. 3 and 5, both the spout elements 22 and 24 define one half of the completed spout construction and are complementary to each other so as to be interfitted to form the completed hollow spout. In this connection, the outer surface of the spout element 22 has a convex configuration while the inner surface is concave and defines an inner channel indicated at 26 that defines one half of the opening formed in the hollow spout when the spout elements 22 and 24 are joined. The spout element 24 has a configuration similar to element 22, and the inner surface thereof is also concave and defines a channel 28 that cooperates with the channel 26 to define the opening through the assembled spout when the elements 22 and 24 are united.

The assembled spout 20 is formed in the usual configuration and includes a larger base end 29 and a smaller outer end 31 from which the liquid is poured. It is understood, that the larger base end 29 is joined to the body 12 which also has a suitable opening formed therein, thereby providing for communication between the interior of the container body 12 and the hollow spout 20. As described above, since the spout elements 22 and 24 are cast of a lead alloy material, it is necessary that the interior surfaces thereof and those surfaces that define the channels 26 and 28 and which normally would be contacted by a liquid poured from the container 10 have a protective coating applied thereto. For this purpose, any suitable protective coating that would not produce any harmful effects when contacted by liquid can be utilized, and it is contemplated that a nickel alloy plating be applied to the channels 26 and 28 of the spout elements 22 and 24, respectively. As illustrated in FIG. 3, all of the exposed surfaces of the spout elements 22 and 24 have been plated with a protective coating such as a nickel, the nickle coating having been applied to all of the surfaces of the elements 22 and 24 as a matter of convenience in the plating operation. In this connection any suitable commercial plating procedure can be utilized and the nickel alloy may vary in composition depending upon the commercial process surfaces of Normally, a copper plating is first applied to the surfacesof contemplated after a suitable cleaning preparation such a dipping into an acid solution, the copper plating also defining a preparatory step for the nickel plating. It is understood that the copper and nickel plating steps are conventional and that any suitable plating thickness can be obtained so long as the inside surfaces of the lead spout elements 22 and 24 are sufficiently coated to prevent contact of liquid therewith when the container 10 is in use. As indicated, any suitable procedure or technique can be utilized in the plating of the spout elements 22 and 24, but it is c ontemplated that the spout elements will be dipped into a plating solution and retained therein for a suitable period of time and in accordance with the base material from which the spout elements are formed so as to obtain the required coating of predetermined thickness.

Referring again to FIG. 3, each of the spout elements 22 and 24 are shown formed with marginal surfaces in which grooves 30 and 32, respectively, are formed. The grooves 32 are proportioned for receiving a strip of solder material 34 therein that is utilized in the joining of the spout elements 22 and 24 together. In order to properly locate the spout elements 22 and 24 relative to each other, locating pins 36 and 38 are formed on flanges 40 and 42, respectively, that flanges 40 and 42 being formed as an extension of a marginal surface of each spout element 22 and 24. Appropriately formed bores 44 and 46 are also formed in the outer surfaces of the elements 22 and 24 opposite to the flanges 40 and 42, respectively, and receive the pins 36 and 38 therein when the spout elements are placed in mating contact.

As illustrated in FIG. 5, the flanges 40 and 42 overlap the adjacent mating surfaces of the spout elements 22 and 24, and thereby prevent leakage of solder material through the seams defined by the marginal surfaces of the spout elements when the elements are soldered together.

With the spout elements 22 and 24 located in mating relation as illustrated in FIG. 5 and with the solder strip material 34 located in the grooves 30 and 32 as illustrated in FIG. 3, heat is applied to the spout elements adjacent to the flanges 40 and 42 so as to cause the solder strip material 34 to flow and produce a connecting joint between the spout elements. As illustrated, the flanges 40 and 42 overlap the mating seams of the spout elements and prevent the flowing solder from escaping through the mating seams.

When the spout elements 22 and 24 have been joined, a through passage 48 is defined by the plated channels 26 and 28, the nickel plating forming a protective barrier for liquid passing therethrough when the spout 20 is attached to the container 12.

The spout 20 in its assembled construction is attached to the body 12 of the container 10 in any usual manner, and this is normally accomplished by soldering the larger end 29 to the body 12 adjacent to the opening that communicates with the interior of the body 12. The solder that is employed for joining the assembled spout 20 to the body 12 has a melting point that is somewhat less than the solder strip 34 that is utilized to join the spout elements together, whereby the seam as formed between the assembled spout elements is prevented from separating by the heat applied when the spout is being soldered to the body.

The assembled spout 20 and container 10 can be suitably ornamented, painted or otherwise decorated in any conventional manner so as to conform the external surfaces of the spout with the complementary surfaces of the container 10.

Thus it will be seen that whereas it would not be possible to effectively plate the inner surface of the spout 20 if the latter were cast in one piece, the present invention overcomes this problem by casting the spout in sections, after which the sections may easily be plated prior to their being assembled to form the completed spout. By this technique it becomes possible to cast the spout sections of lead, whereby pronounced economic advantages are obtained.

It is also contemplated to coat the inside surfaces of the spout elements 22 and 24 with only a copper plating or with only a nickel plating, or if it is desired, a protective coating such as an epoxy resin may be sprayed thereon. The spray technique may also be utilized to apply a powdered metalized material such as tin or the like to the inside surface of the elements 22 and 24, wherein an effective protective coating is produced thereon.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of forming a spout for use in a liquid container, comprising the steps of forming a pair of complementary spout elements into longitudinally extending sections, wherein each section extends the length of said spout and is formed with a concave inner surface so that a through passage is defined by said sections when they are located in the joined position thereof, coating the concave inner surface of each section with a plating material prior to joining said sections together for eliminating any deleterious effects of the material from which said sections are formed when the container is in use and liquid in the container is poured through the passage in the spout, joining the spout elements together along their longitudinally extending edges to form the spout, and mounting the spout on said container.

2. A method as claimed in claim 1, wherein each of said complementary spout elements are cast of a lead material.

3. A method as claimed in claim 2, comprising the further steps of joining said spout elements together by soldering, wherein the solder used has a predetermined melting temperature, and joining the assembled spout to the container by soldering and using a solder that has a melting temperature less than that for joining the spout elements together.

4. A method as claimed in claim 2, wherein the protective coating comprises a nickel alloy.

5. A method as claimed in claim 2, comprising the further step of forming said cast spout elements with mating surfaces in which longitudinally extending grooves are formed, placing a strip of solder material in the grooves in said mating surfaces and heating the cast elements in the area of the grooves to form an effective solder joint between the said cast elements.

6. A method as claimed in claim 5, wherein the protective coating comprises a nickel alloy.

* * * * *